United States Patent [19]

Riesen

[11] 4,139,997

[45] Feb. 20, 1979

[54] PATTERNING DEVICE FOR ACTUATING OPERATING ELEMENTS OF TEXTILE MACHINERY

[75] Inventor: Peter Riesen, Winterthur, Switzerland

[73] Assignee: Sulzer Brothers Limited, Winterthur, Switzerland

[21] Appl. No.: 774,609

[22] Filed: Mar. 4, 1977

[30] Foreign Application Priority Data

Mar. 5, 1976 [CH] Switzerland ..... 2756/76

[51] Int. Cl.[2] ..... D04B 27/02; D04B 27/08; F16H 21/16

[52] U.S. Cl. ..... 66/207; 66/1 R; 74/25; 139/79

[58] Field of Search ..... 66/207, 13, 1 R, 154 R, 66/50 R, 138, 203, 204, 208; 139/55.1, 436, 79; 74/89.2, 89.21, 25

[56] References Cited

U.S. PATENT DOCUMENTS

| | | | |
|---|---|---|---|
| 2,997,867 | 8/1961 | Engelhard | 66/207 X |
| 3,124,163 | 3/1964 | Slayter | 139/436 |
| 3,124,164 | 3/1964 | Ewing | 139/436 |
| 3,124,165 | 3/1964 | Slayter et al. | 139/436 |
| 3,149,648 | 9/1964 | Laithwaite | 139/55.1 |
| 3,401,537 | 9/1968 | Kohl | 66/207 |
| 3,444,702 | 5/1969 | kohl | 66/208 |
| 3,589,416 | 6/1971 | Zuercher | 74/25 X |
| 3,727,646 | 4/1973 | Mares | 139/436 X |
| 3,877,255 | 4/1975 | Allavena | 66/13 |
| 3,902,335 | 9/1975 | Durville | 66/13 |
| 3,952,549 | 4/1976 | Kohl | 66/207 |
| 3,987,648 | 10/1976 | Fillmore, Jr. et al. | 66/207 |

FOREIGN PATENT DOCUMENTS

| | | | |
|---|---|---|---|
| 950874 | 10/1956 | Fed. Rep. of Germany | 66/207 |
| 2010602 | 9/1970 | Fed. Rep. of Germany | 66/207 |

*Primary Examiner*—Werner H. Schroeder
*Assistant Examiner*—Andrew M. Falik
*Attorney, Agent, or Firm*—Kenyon & Kenyon, Reilly, Carr & Chapin

[57] ABSTRACT

A patterning device employs an elongated strip which is fixed between an operating element, such as a guide bar of a warp knitting machine, and a fixed support point. In addition, the patterning device has a displacing element in the form of a rotatable eccentric or a reciprocally mounted roller which is used to deflect the strip between two points intermediately of the length of the strip so as to exert a pulling force on the guide bar. The amount of deflection of the strip determines the amount of movement of the guide bar. The guide bar can be returned by way of a spring or by a second strip which is deflected in similar manner as the first strip by a displacing element. In one embodiment, a single displacing element is used for deflecting purposes while in other embodiments, a multiplicity of displacing elements are used. The strips may be attached directly to the guide bar or indirectly, for example, over a pivotally mounted lever.

19 Claims, 8 Drawing Figures

| | | | | | | | | | | | | | | | | | | | | | |
|---|---|---|---|---|---|---|---|---|---|---|---|---|---|---|---|---|---|---|---|---|---|
| 51 | 1 | ● | | ● | | | ● | | ● | | | ● | ● | ● | ● | ● | ● | | | | |
| 52 | 2 | | ● | | | | ● | | | ● | | ● | | ● | | ● | | ● | | | |
| 53 | 4 | | ● | | ● | | ● | | | ● | | ● | | | ● | ● | | | ● | | |
| 54 | 8 | ● | | | | | | ● | ● | | | ● | | ● | | ● | | | | | ● |
| 55 | 16 | | | ● | ● | | | ● | ● | | ● | | | | ● | ● | | | | | |
| 56 | 32 | | | | | ● | | ● | | ● | | | ● | ● | ● | ● | | | | | |

PATTERNING DEVICE FOR ACTUATING OPERATING ELEMENTS OF TEXTILE MACHINERY

This invention relates to a patterning device for actuating operating elements of textile machinery. More particularly, this invention relates to a patterning device for actuating the guide bars of a warp knitting machine.

As is known, warp knitting machines have guide bars which require movement relative to the needles of the machine. Generally, these machines have patterning devices for moving the guide bars. In many cases, the patterning devices employ chains for controlling the motion of the guide bars. However, chain operation has a disadvantage of requiring extensive fitting work on the machine when production has to be changed to a product of a different pattern. This has consequent economic disadvantages. Another disadvantage is that the chains which have to be used for patterns having a considerable repeat length become excessively heavy and bulky.

Accordingly, it is an object of the invention to provide a patterning device which does not require extensive transformation work on a textile machine when production is changed to a different product.

It is another object of the invention to provide a patterning device which is able to produce patterns having considerable repeat lengths.

It is another object of the invention to provide a simple patterning device which can be used for a multiplicity of pattern repeat lengths.

It is another object of the invention to provide a patterning device of relatively simple construction.

It is another object of the invention to provide a patterning device which is able to use an electronic pattern storage facility.

Briefly, the invention provides a patterning device for moving at least one operating element of a textile machine in a relatively simple programmed manner. The patterning device includes an elongated pull element which is secured to the operating element and at least one displacing element for selectively varying the effective length of the pull element relative to the operating element.

The operating element may be of any suitable construction; however, in the present case, the operating element is a guide bar of a warp knitting machine.

The displacing element may be in the form of an eccentric which is disposed for selectively engaging and displacing the pull element or may be mounted for rectilinear movement to vary the effective length of the pull element. To this end, the effective length refers to that length of the pull element which is operative on the operating element.

The patterning device allows the use of an electronic pattern storage facility. Since the data base for the pattern of such a facility may be very large, the patterning device allows the production of patterns having a correspondingly considerable length.

In one embodiment, a single displacing element in the form of an eccentric may be used to engage the pull element at least during the displacement step. In this case, the eccentric contacts the strip between two points between which the strip may deflect. The resultant deflection causes a shortening of the effective length of the strip such that the pull element is moved in the direction of the strip. This may be termed a retracted position. When the eccentric releases the strip, a suitable restoring element may be used to return the pull element and the strip to the initial position.

In another embodiment, a plurality of displacing elements are used for changing the effective length of the pull element. In this case, the displacing elements are disposed in a row along the elongated strip and a plurality of rollers are also disposed in engagment with the strip on a side opposite from the displacing elements and in alternating relation with the displacing elements. These rollers act as backup elements such that the strip can be deflected at a multiplicity of points. Both the rollers and displacing elements can be adjustably mounted relative to each other along the strip. This allows the distance between the rollers and displacing elements to be adjustable so that the angle of engagement between the strip and the displacing element is adjustable.

In another embodiment, a plurality of displacing elements are arranged in the fashion of a pulley block.

One advantageous arrangement of a plurality of displacing elements is to have the elements disposed in a configuration such that the pull element engages some of the displacing elements with an angle of 180° while engaging the remaining displacement elements with an angle less than 180°.

Advantageously, the operating element is so actuated that the operative movements or throws imparted by the discrete displacing elements to the operating element are related to one another as digits of the binary system.

In order to have the displacing element remain stationary relative to the pull element during a displacement step without friction between the two, the displacing element may employ a ring which is rotatably mounted on the displacing element and which acts on the pull element.

Preferably, the displacing element is lockable in two different positions.

In order to widen the range of possible adjustments, the pull elements can be connnected via a lever to the operating element and can be secured to the lever at various positions.

For zero adjustment of the pull element setting, the operating element can be connected to a fixed point.

In order to provide a positively actuated return movement of the operating element, the resetting element can be in the form of a second pull element with an associated displacement element for altering the effective length of the second pull element. In this case, the second pull element is connected to the operating element to function in opposition to the first pull element. In this case, a single displacing element can be used to engage the two pull elements for the back and forth movement of the operating element.

These and other objects and advantages of the invention will become more apparent from the following detailed description and appended claims taken in conjunction with the accompanying drawings in which:

Figures 3A, 3B:
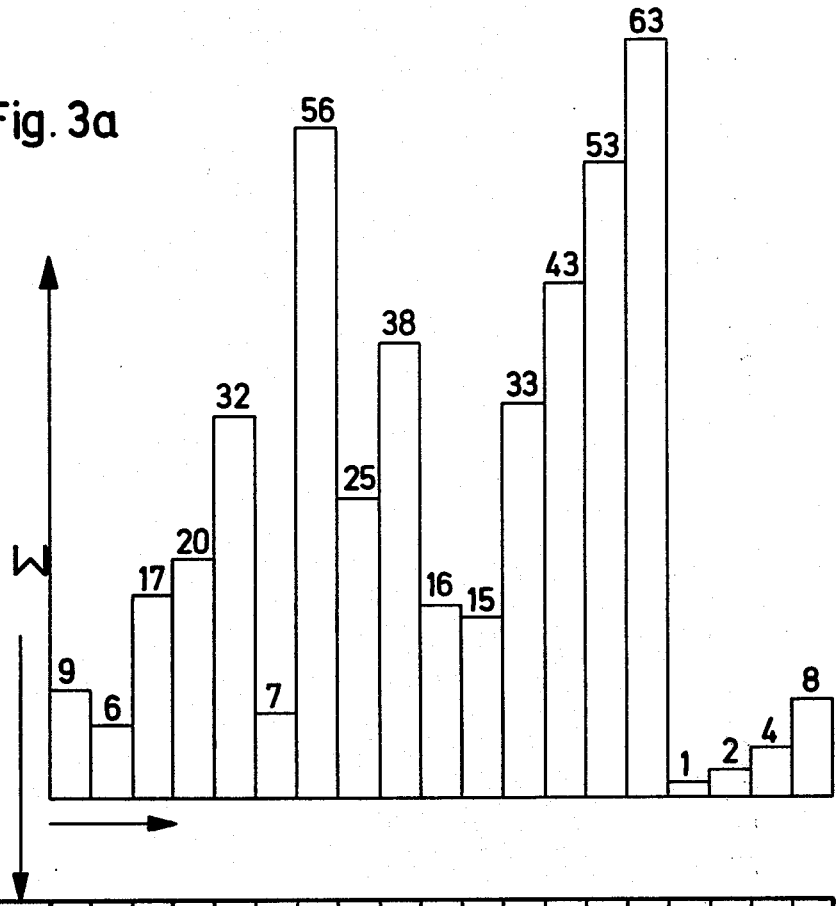
Figure 4:
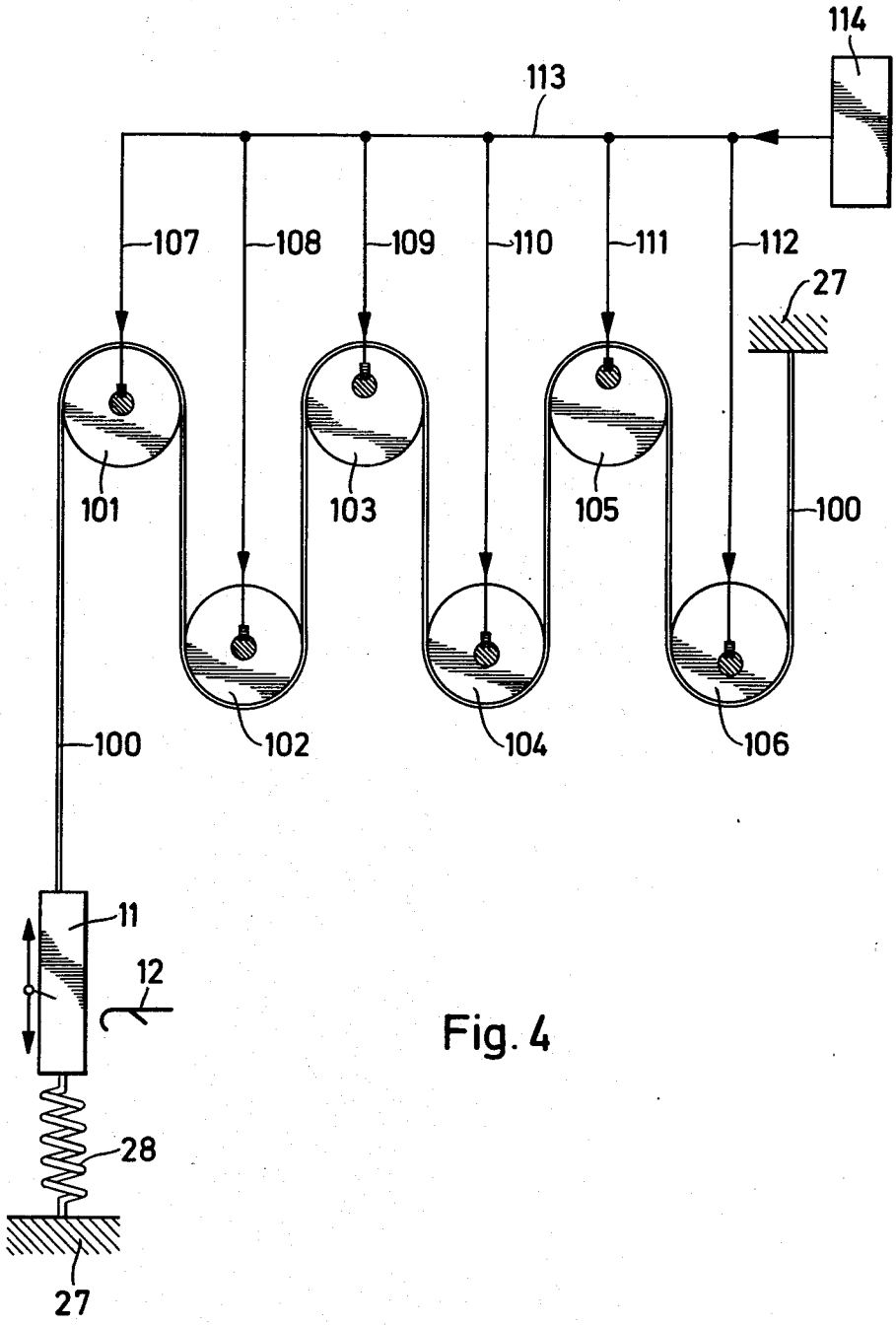
Figure 5:
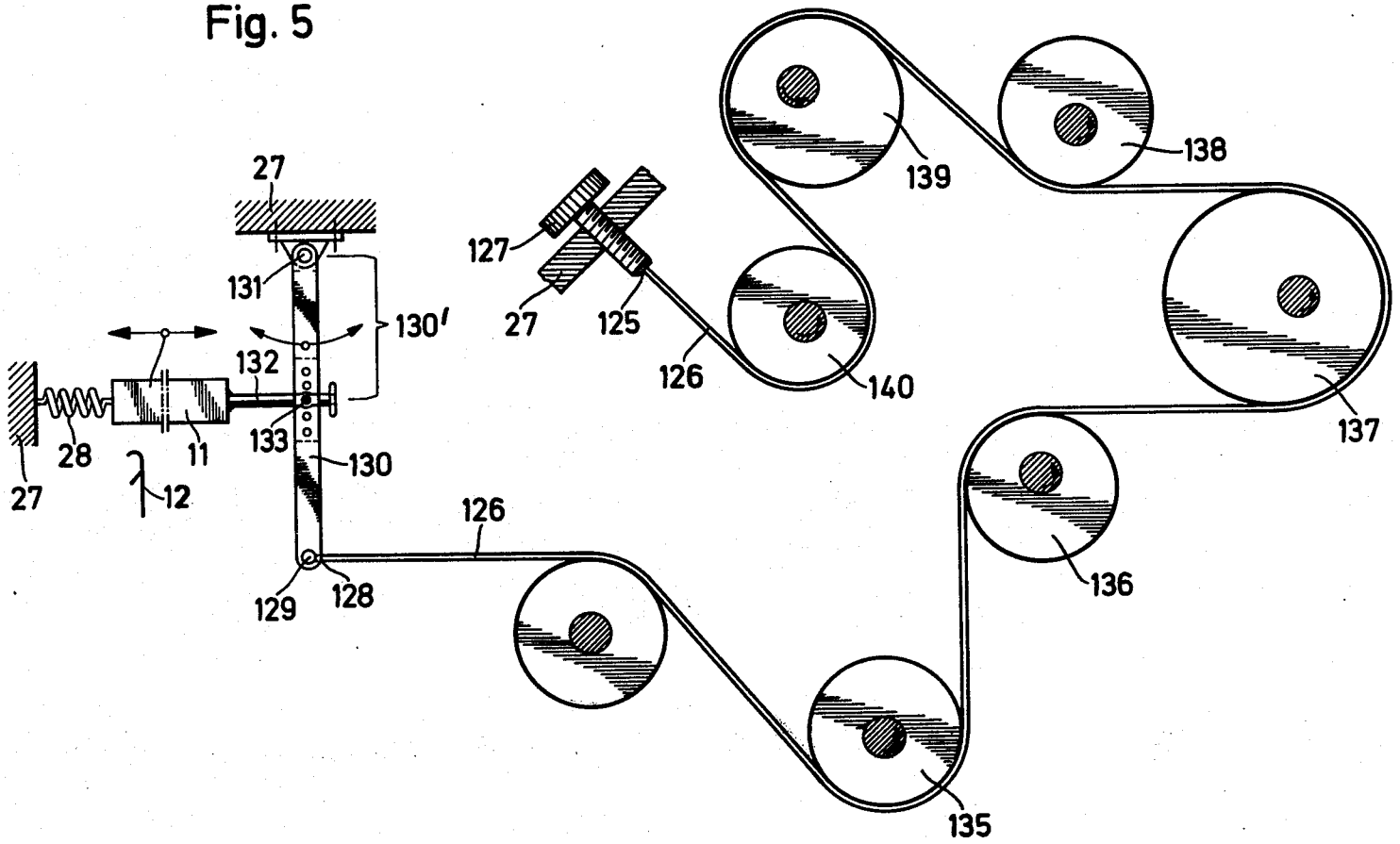
Figure 6:
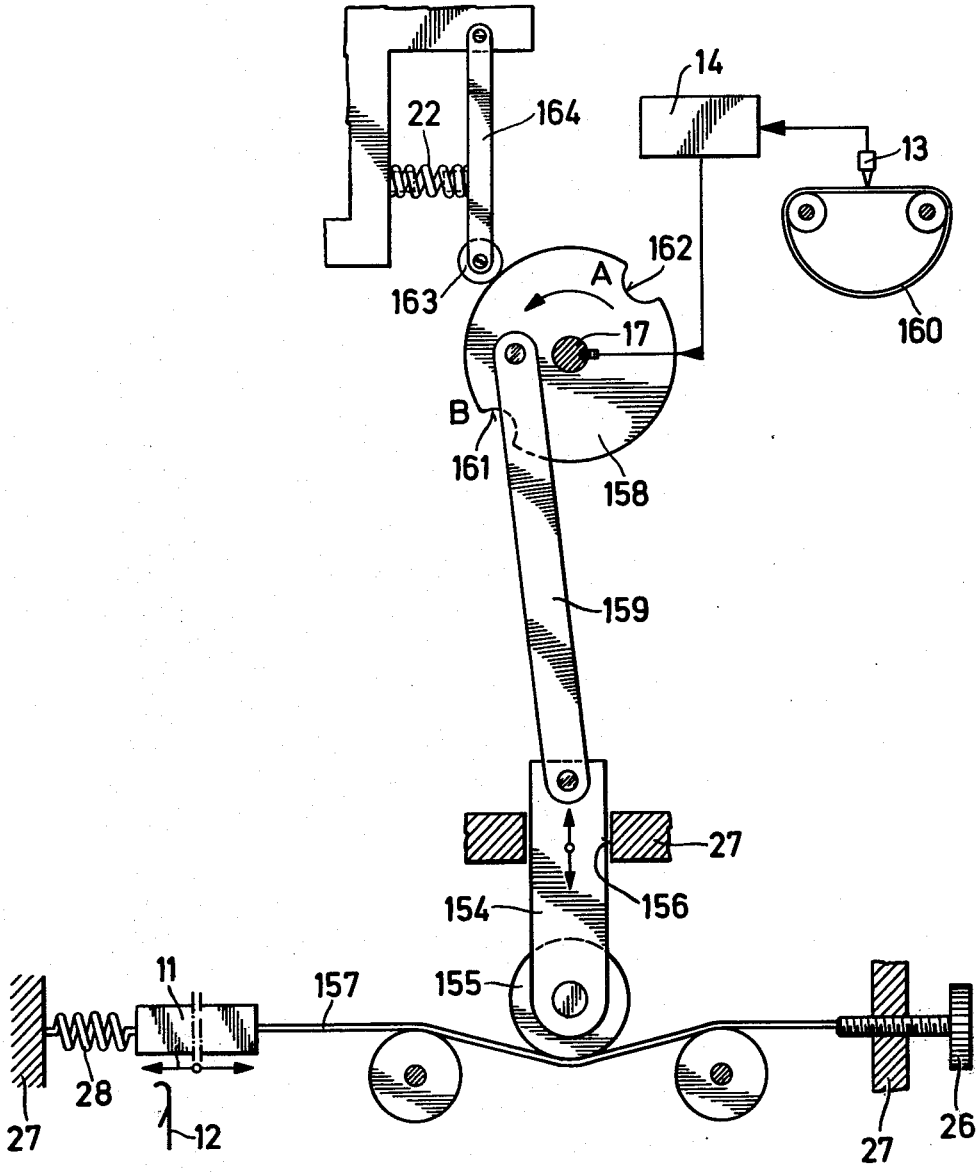
Figure 7:
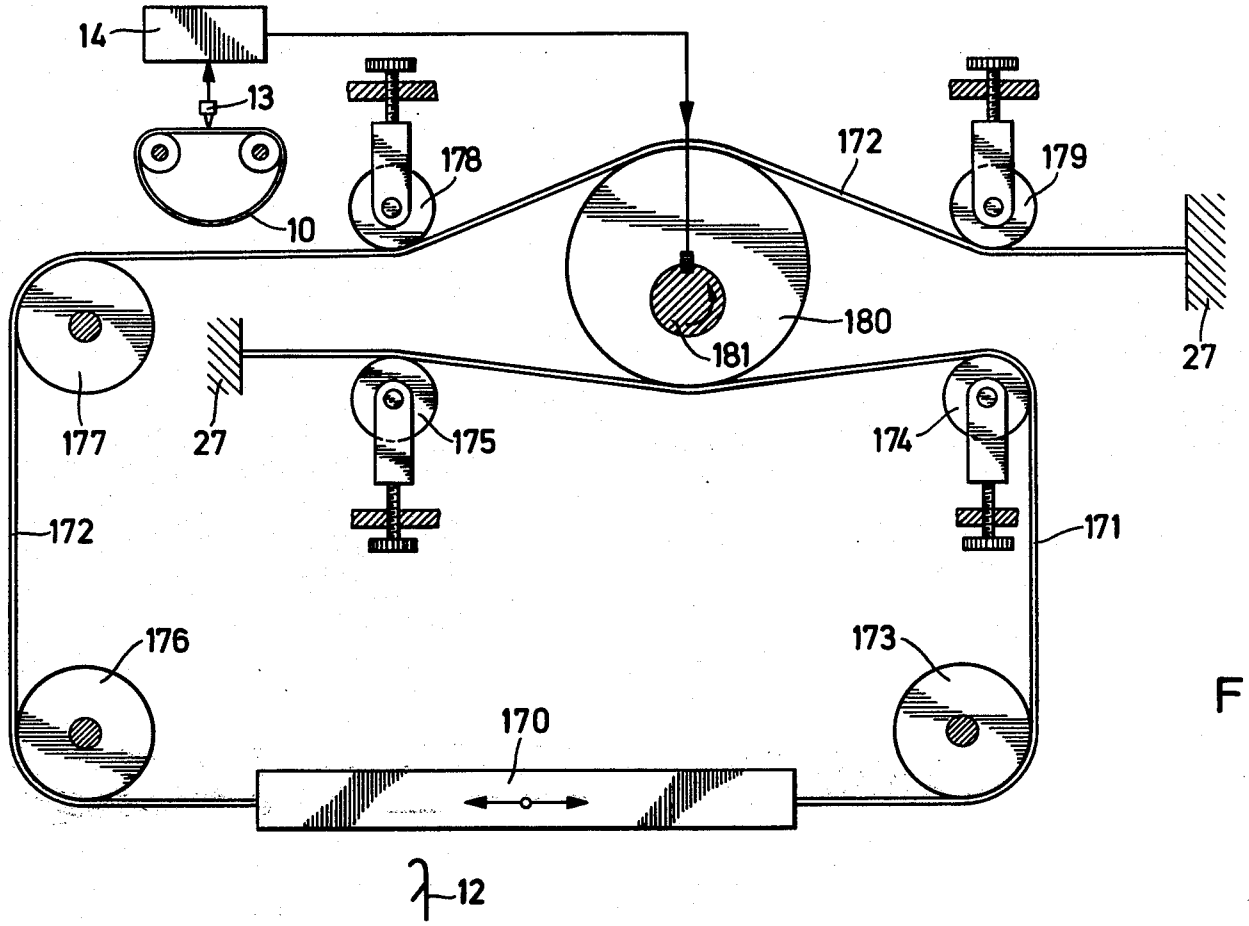

FIGS. 3*a* and 3*b* diagrammatically illustrate a combination diagram showing possible throws or operative movements of a guide bar in accordance with the invention;

FIG. 4 illustrates a further embodiment employing a plurality of displacing elements in the form of a pulley block in accordance with the invention;

FIG. 5 illustrates a further modified patterning device according to the invention having a pull element connected to an operating element via a lever;

FIG. 6 illustrates a modified patterning device employing a displacing element which moves in a rectilinear fashion; and FIG. 7 illustrates a further modification of a patterning device according to the invention employing a displacing element which functions to displace and restore an operating element from and to an initial position.

Figure 1:
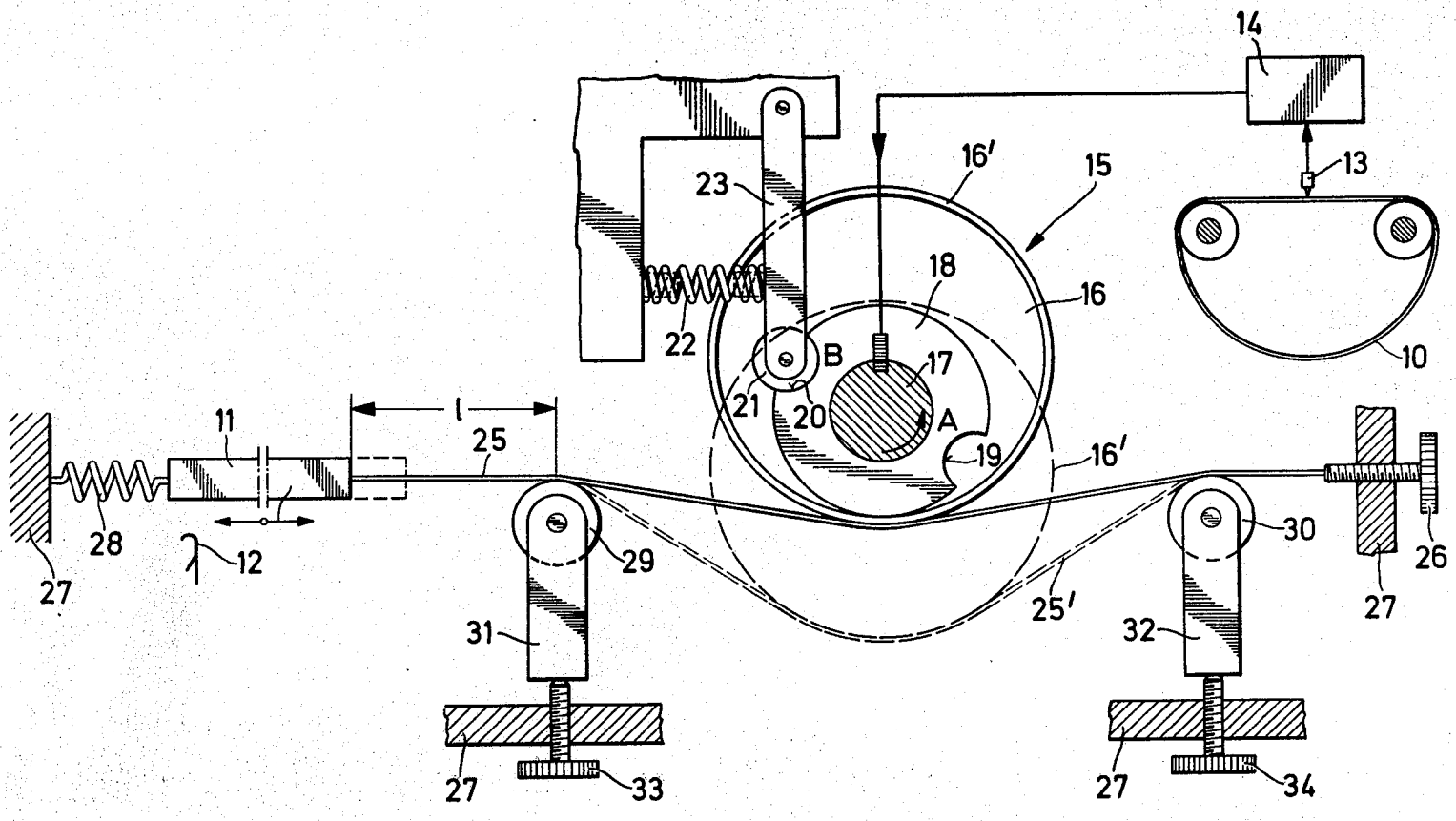
FIG. 1 illustrates a patterning device according to the invention.

Referring to FIG. 1, in order to move an operating element in the form of a guide bar 11 of a warp knitting machine in relation to a needle 12, a patterning device is secured to the guide bar 11. In addition, the patterning device cooperates with an information base of a storage facility, such as a film strip 10 which contains data on the lengthwise positions to be taken up by the guide bar 11 in relation to the needle 12 in order that a knitted article may be produced with the required pattern. To this end, a reading head 13 is used to read the stored data on the film strip 10 and to generate signals in response which pass via an amplifier 14 to a displacing element 15 of the patterning device.

The displacing element 15 is shown in diagrammatic form and mainly comprises an eccentric 16 which is adapted to be engaged with and disengaged from a drive shaft 17. The eccentric 16 can be locked in two positions A, B which are disposed at a 180° offset from one another and, accordingly, has a locking plate or disc 18 formed with two diametrically opposite recesses 19, 20 which are engageable by a locking roller 21 mounted on a lever 23 which is biased by a spring 22 towards the disc 18.

As shown, the patterning device employs a pull element in the form of a pull strip 25 which is secured at one end to the guide bar 11 and at the other end by means of an adjusting screw 26 to a machine frame 27. The opposite end of the guide bar 11 is connected by way of a restoring element such as a tension spring 28 to the machine frame 27. The strip 25 engages the eccentric 16 and is maintained in contact with the eccentric 16 by two rollers 29, 30. These latter rollers 29, 30 also serve to adjust the operative movement or throw of the guide bar 11 and are each rotatably mounted in a respective holder or the like 31, 32. The holders 31, 32 are mounted on threaded screws 33, 34, respectively, which are threaded into the machine frame 27 as shown.

During use, when the eccentric 16 is engaged with the drive shaft 17 in response to a signal from the data storage facility 10, the shaft 17 rotates the eccentric 16, for example, in a counterclockwise direction as viewed. Consequently, the center of the eccentric 16 moves transversely of the pull strip 35 so that the pull strip is displaced to take up a deflected position 25'. The length of the strip 25 between the rollers 29, 30 thus increases and the effective length of the strip 25 which is operative on the guide bar 11 decreases by the same amount so that the guide bar 11 is moved the same distance to the right as viewed. That length of the strip 25 which is operative on the guide bar 11 in order to determine the position of the guide bar 11 is the length l of the strip 25 between the place where the strip is connected to the guide bar 11 and the place where the strip makes tangential contact with the roller 29. This length is thus the effective position-determining length of the pull element or strip 25. After 180° of rotation, the eccentric 16 disengages from the drive shaft 17. The roller 21 then engages in the recess 19 and locks the eccentric 16 in position.

If the guide bar is to remain in the position just reached during the next stroke of the machine, the storage facility 10 does not produce a signal to engage the drive shaft 17 with the eccentric 16. As a result, the eccentric 16 does not rotate. However, if the guide bar 11 is required to return to the initial position, the eccentric 16 is engaged with the drive shaft 17 in response to a signal from the storage facility 10 and turns another 180° until the roller 21 engages in the recess 19. That length of the portion of the pull strip 25 between the rollers 29, 30 which has been released in this step is then taken up by the tension spring 28. The tension spring 28 thus pulls the guide bar 11 back to the initial position.

The initial position of the guide bar 11 relative to the needle 12 can be adjusted by the adjusting screw 26. This adjustment, however, does not effect the change which is brought about by the eccentric in the effective length of the pull strip 25, i.e. the operative movement or throw of the guide bar 11. When the eccentric 16 is in the initial position as shown in FIG. 1, the angle of engagement between the strip 25 and the eccentric 16 is determined by the height of the rollers 29, 30. In order to change the amplitude of the guide bar throw, the angle of engagement between the strip 25 and the eccentric 16 can be changed by altering the height of the rollers 29, 30 by rotation of the screws 33, 34. For a given eccentricity of the eccentric 16, the guide bar throw increases in proportion as the engagement angle between the strip 25 and the eccentric 16 becomes greater. Of course, the guide bar throw can be varied by varying the eccentricity of the eccentric 16.

In order to prevent the periphery of the eccentric 16 from rubbing on the pull element 25 as the eccentric 16 rotates, the eccentric 16 is constructed with a ring 16' which is rotatably mounted on the periphery of the actual eccentric with the interposition of a ball bearing (not shown). This ring 16' remains stationary relative to the strip 25 as the eccentric 16 rotates.

The strip 25 need not necessarily be in permanent engagement with the eccentric 16. Such engagement is necessary only during the displacement or operative position. Also, instead of using a pull strip, a full cable or chain can be used.

Figure 2:
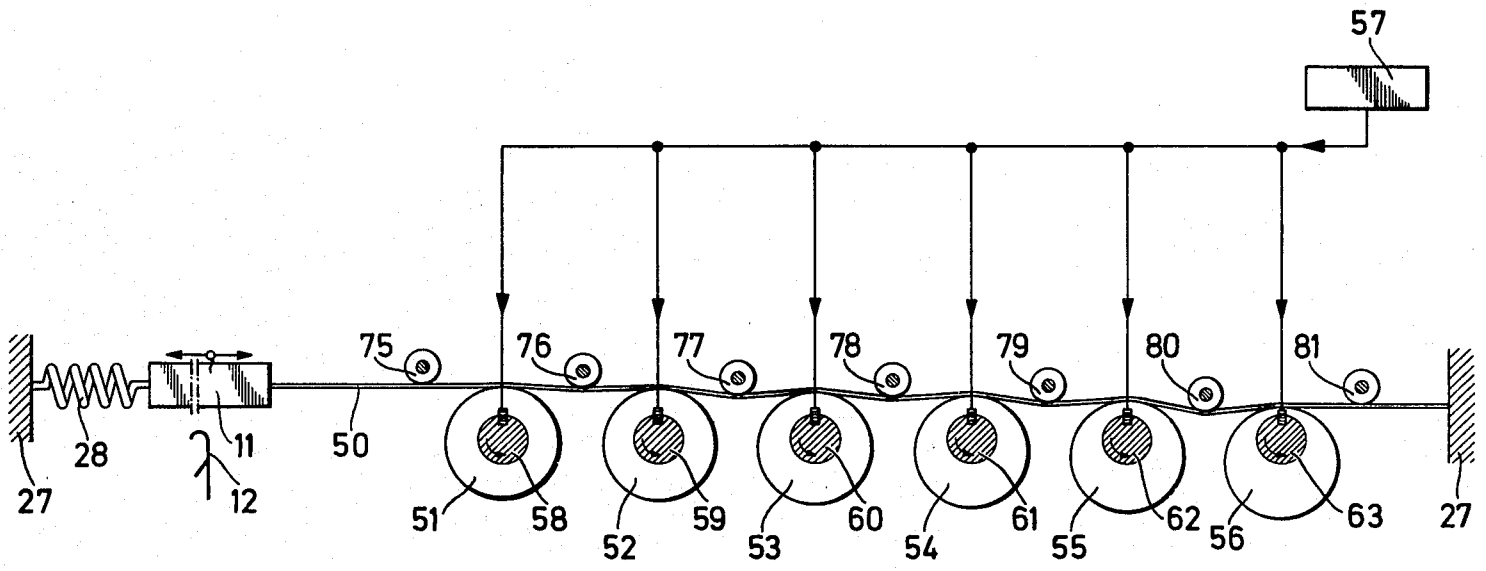
FIG. 2 illustrates a patterning device according to the invention having a plurality of displacing elements.

In order to allow the guide bar 11 to perform a number of different throws, a plurality of eccentrics can be disposed in a row. To this end, as shown in FIG. 2, a single pull strip 50 may be engaged by six eccentrics 51 – 56 which extend between the guide bar 11 and the machine frame 27. As described with respect to FIG. 1, each eccentric 51 – 56 is engaged, individually or in combination with other eccentrics, with an associated drive shaft 58 – 63 in accordance with signals emitted by a pattern storage facility 67. The eccentricity of the eccentrix 51 – 56 varies. To this end, each eccentric produces a guide bar throw twice as great as the throw produced by the immediately previous eccentric as considered in the direction away from the guide bar 11. For example, the guide bar throw produced by the fifth eccentric 55 is 16 times the throw produced by the eccentric 51 alone. The throw of the eccentric 51 is referred to here as the unit throw and is equal to the needle division. Consequently, proceeding in order from left to right, the guide bar throw produced by consecutive eccentrics 52 – 56 are greater than the unit throw by factors of 2, 4, 8, 16 and 32. These factors are place values of the binary system. When two or more eccentrics are engaged, the resulting guide bar throw is the sum of the throw produced by the individual eccentrics. When the number of eccentrics used is X, all throw values can be combined up to a maximum of $S^X$ unit throws. This function is more easily understood from FIGS. 3*a* and 3*b*.

Referring to FIG. 3*a*, a number of possible positions of a guide bar relative to a needle 12 are illustrated. The number multiplied by the amount of a needle division or a unit throw gives the distance by which the guide bar must move to the right from the normal position.

Referring to FIG. 3*b*, the eccentrics which must be moved to the limit displacement position to provide the required total throw are marked with a dot. All of the unmarked eccentrics must, of course, remain in their normal position. Each dot indicates that the eccentric thus marked is in the chain line position 16' of FIG. 1. For instance, in order to produce the throw 38, the eccentrics 51, 53 and 56 must be used, since their respective individual throws are twice, four times and 32 times the unit throw in order to give a total of 38 times the unit throw.

Referring to FIG. 2 the eccentrics need not be arranged with eccentricities which increase from left to right. Instead, it is possible for the eccentrics to be arranged arbitrarily.

In order to prevent disengagement of the pull strip from any eccentric by the movement of one or two adjacent eccentrics, rollers 75 – 81 are provided to keep the pull strip 50 in engagement with the respective eccentrics 51 – 56. These rollers 75 – 81 can be embodied as throw-adjusting rollers as a means of varying the angle of engagement between the pull strip 50 and the eccentrics 51 – 56 and therefore of adjusting eccentricity.

Referring to FIG. 4, wherein like reference characters indicate like parts as above, the patterning device may employ a plurality of eccentrics 101 – 106 which are disposed in an arrangement which resembles a pulley block. Such an arrangement aids in providing a compact construction. As illustrated, a pull strip 100 engages the eccentrics 101, 106 consecutively and engages each eccentric with an angle of 180°. All of the eccentrics 101, 106 may or may not have the same eccentricity which can be individually adjustable. The drive for each eccentric 101 – 106 is shown schematically in the form of lines 107 – 112 which are connected via a line 113 to a knitting pattern storage facility 114. No throw adjusting rollers are necessary in this arrangement due to the pulley block relationship between the eccentrics. In addition, the throw of any one eccentric does not effect the throw of the others.

In the illustrated system of FIG. 4, the displacement distance of the eccentrics 101, 106 is varied by the adjustment of their eccentricity. Of course, eccentric disc arrangements similar to other kinds of pulley blocks are also possible.

Referring to FIG. 5, wherein like reference characters indicate like parts as above, the patterning device may employ an arrangement of eccentrics in which the pull strip 126 engages the various eccentrics 135 – 140 with different angles. In addition, one end 125 of a pull strip 126 is secured by means of an adjusting screw 127 to the machine frame 27 while the other end 128 is connected to a free end 129 of a lever 130 which is rotatable about a fixed pivot 131 of the machine frame 27. The guide bar 11 has one end connected via a rod 132 to a selective intermediate position 133 on the lever 130 while the other end is connected via a tension spring 28 to the frame 27. The length of the lever part 130' between the pivot 131 and the position 133 must be a multiple of the total possible displacement of the guide bar 11. The strip 126 engages in consecutive fashion with the eccentrics 135 – 140. In addition, the angle of engagement between the strip 126 and the eccentrics 137, 139, 140 is 180° and is less than 180° in the case of the eccentrics 135, 136, 138. The angle of engagement relative to the eccentrics 137, 139, 140 is not limited to 180° but may be in a range of from 170° to 190°.

All of the eccentrics 135 – 140 are fixedly mounted on the machine frame 27 and the guide bar throws can be adjusted by changing the eccentricity of the eccentrics. The positions of the eccentrics 135 – 140 relative to one another are such that the large throws of the guide bar 11 cannot interact with one another. The error arising when an eccentric 135 or 136 or 138 is used together with a respective adjacent eccentric 137 or 139 or 140 due to a change of the angles of engagement relative to one another is so slight that not correction is necessary even in the most extreme combination. The advantages of the illustrated system is that the sum of the angles of engagement between the eccentrics 135 – 140 and the strip 126 is smaller than in the system as illustrated in FIG. 4 and that no adjustable backup rollers are required.

The eccentrics are of different eccentricities which are so calculated that, in the sequence of eccentrics 138, 136, 135, 140, 139, 137, the guide bar throw produced by any eccentric is twice the guide bar throw produced by the immediately preceding eccentric. As described with reference to FIG. 2, the different guide bar throws are consecutively as many times greater than the unit throw as the product thereof with the relevant place value 1, 2, 4, 8 and 16 of the binary system. Throws as described with respect to FIGS. 3*a* and 3*b* can be provided by the use of a number of eccentricites simultaneously. The guide bar throw can be adjusted by shifting the position 133 where the rod 132 is secured to the lever 130. Accordingly, the lever 130 is formed with a slot in which the rod 132 can be moved and secured.

Referring to FIG. 6, wherein like reference characters indicate like parts as above, instead of employing an eccentric, the displacing element can be constructed as a rectilinear moving element which is reciprocated with the required travel relative to the pull element 157. To this end, the element is in the form of a roller 155 which is mounted on a reciprocable rod 154. As shown, the rod 154 is guided in a bore 156 of the frame 27 and a roller 155 engages the pull strip which is secured to the guide bar 11. The guide 164 is reciprocated vertically as shown through the agency of a crank plate 158 and a crank rod 159. Rotation of the crank plate 158 is initiated by a pattern storage facility 160. In addition, the plate 158 is formed of two peripheral recesses 161, 162 which cooperate with a blocking roller 163 which is secured to a spring biased lever 164. The operation of this patterning device is similar as to that described with respect to FIG. 1.

The rod 154 can be driven in some other way than as illustrated in FIG. 6. For example, the rod 154 can be a piston rod of a hydraulic or pneumatic motor or the armature of an electro-magnet. Of course, a number of rectilinear moving displacing elements can be used and arranged in various configurations in the same manner as eccentrics are used.

Referring to FIG. 7, wherein like reference characters indicate like parts as above, instead of employing a spring as a restoring element, the restoring element for the guide bar 170 can be in the form of a further displacing element. In this case, the two ends of the guide bar 170 are connected to the machine frame 127 by way of two separate pull strips 171, 172, the guide bar 170 being disposed substantially centrally between the two strips 171, 172. One strip 171 is trained over a deflecting roller 173 and two throw adjusting rollers 174, 175. The other strip 172 is trained over two deflecting rollers 176, 177 and two throw-adjusting rollers 178, 179. In addition, the patterning device includes a single eccentric 180 which is driven by a shaft 181 which eccentric 180 acts on the two strips 171, 172. The drive of the eccentric 180 functions as described with respect to FIG. 1. During use, when the eccentric 180 descends, the strip 171 is deflected downwardly. As a result, the effective length of the strip 171 is reduced and the guide bar 170 is pulled to the right as viewed. However, the displacing action of the eccentric 180 on the strip 172 decreases so that the effective length of the strip 172 increases and the pull on the strip 172 decreases. During the next half revolution of the eccentric 181, that is when the eccentric rises, the displacing effect on the strip 171 decreases while increasing on the strip 172. The guide bar 170 therefore moves to the left as viewed. The advantage of this return feature is that the guide bar 170 is returned in a positive fashion. Unlike the restoring force which occurs in the case of a tension spring, the restoring force acting on the guide bar 170 is constant and does not vary.

When a number of guide bars are used in one machine, a patterning device and/or a restoring element must be associated with each guide bar.

Although the above embodiments relate only to the actuation of guide bars, the patterning device may, of course, also be used for the actuation of other operating elements of textile machinery where actuation is required with various factors which can be complied from a number of regulated quantity units.

What is claimed is:

1. The combination of at least one operating element of a textile machine and a patterning device for moving said operating element, said patterning device including an elongated flexible pull element secured to said operating element and at least one displacing element for selectively varying the effective length of said pull element relative to said operating element, said pull element being partially engaged with said displacing element at least during a displacing operation.

2. The combination as set forth in claim 1 wherein said operating element is a guide bar of a warp knitting machine.

3. The combination as set forth in claim 1 wherein said displacing element is an eccentric disposed for selectively engaging and displacing said pull element.

4. The combination as set forth in claim 1 wherein said displacing element is lockable in two different positions.

5. The combination as set forth in claim 1 wherein said patterning device further includes an adjustment element secured at one end of said pull element and to a fixed point for adjusting an initial position of said operating element.

6. The combination as set forth in claim 1 wherein said patterning device further includes a restoring element, said restoring element including a second pull element secured to said operating element and at least a second displacing element for selectively varying the effective length of said second pull element relative to said operating element.

7. The combination as set forth in claim 1 wherein said patterning device includes a restoring element, said restoring element including a second pull element secured to said operating element and disposed in engagement with said displacing element whereby said displacing element selectively varies the effective length of each of said pull elements relative to said operating element simultaneously.

8. The combination as set forth in claim 1 wherein a plurality of displacing elements are disposed along said pull element, said displacing elements being operative to impart an operative movement to said pull element with said operative movements having a relation to one another as digits of the binary system.

9. A patterning device for moving an operating element of a textile machine, said patterning device including an elongated flexible pull element secured to said operating element at one end and to a fixed point at an opposite end, and at least one displacing element for selectively varying the effective length of said pull element relative to said operating element, said pull element being partially engaged with said displacing element at least during a displacing operation.

10. A patterning device as set forth in claim 9 which includes a plurality of said displacing elements along said elongated pull element.

11. A patterning device as set forth in claim 10 wherein each said displacing element is an eccentric disposed for selectively engaging and displacing said pull element.

12. The combination of at least on operating element of a textile machine and a patterning device for moving said operating element, said patterning device including an elongated pull element secured to said operating element and at least one displacing element for selectively varying the effective length of said pull element relative to said operating element, said displacing element being mounted for rectilinear movement to vary said effective length of said pull element.

13. The combination of at least one operating element of a textile machine and a patterning device for moving said operating element, said patterning device including an elongated strip secured to said operating element, a plurality of displacing elements disposed in a row along said strip for selectively varying the effective length of said pull element relative to said operating element and a plurality of rollers in engagement with said strip on a side opposite from said displacing elements, said rollers being disposed in alternating relation with said displacing elements.

14. The combination as set forth in claim 13 wherein said rollers and said displacing elements are adjustably mounted relative to each other along said strip.

15. The combination of at least one operating element of a textile machine and a patterning device for moving said operating element, said patterning device including an elongated pull element secured to said operating element and a plurality of displacing elements disposed along said pull element in a pulley block arrangement for selectively varying the effective length of said pull element relative to said operating element.

16. The combination of at least one operating element of a textile machine and a patterning device for moving said operating element, said patterning device including an elongated pull element secured to said operating element and a plurality of displacing elements disposed in a row along said pull element with some of said displacing elements engaging said pull element with an angle of 180° and with the remainder of said displacing elements engaging said pull element with an angle less than 180° for selectively varying the effective length of said pull element relative to said operating element.

17. The combination of at least one operating element of a textile machine and a patterning device for moving said operating element, said patterning device including an elongated pull element secured to said operating element and at least one displacing element for selectively varying the effective length of said pull element relative to said operating element, said displacing element including a rotatable eccentric and a ring rotatably mounted relative to said eccentric, said ring being disposed in stationary contact with said pull element.

18. The combination of at least one operating element of a textile machine and a patterning device for moving said operating element, said patterning device including an elongated pull element secured to said operating element, at least one displacing element for selectively varying the effective length of said pull element relative to said operating element, and a pivotally mounted lever secured at an intermediate position to said pull element and at a free end thereof to said pull element.

19. A patterning device for moving an operating element of a textile machine, said patterning device including an elongated pull element secured to said operating element at one end and to a fixed point at an opposite end, and a plurality of displacing elements along said pull element for selectively varying the effective length of said pull element relative to said operating element, each said displacing element being mounted for rectiliner movement to vary said effective length of said pull element.

* * * * *

UNITED STATES PATENT AND TRADEMARK OFFICE

CERTIFICATE OF CORRECTION

PATENT NO. : 4,139,997

DATED : February 20, 1979

INVENTOR(S) : PETER RIESEN

It is certified that error appears in the above-identified patent and that said Letters Patent are hereby corrected as shown below:

Column 2, line 41, change "connnected" to --connected--

Column 5, line 6, change "$S^X$" to --$2^X$--

Column 6, line 23, change "not" to --no--

Column 7, line 42, change "complied" to --compiled--

Column 8, line 38, change "on" to --one--

Signed and Sealed this

*Seventh* Day of *August 1979*

[SEAL]

*Attest:*

*Attesting Officer*

LUTRELLE F. PARKER

*Acting Commissioner of Patents and Trademarks*